US010773112B2

(12) United States Patent
Lenz, Jr. et al.

(10) Patent No.: US 10,773,112 B2
(45) Date of Patent: Sep. 15, 2020

(54) WILDLAND URBAN INTERFACE FIREFIGHTING APPARATUS

(71) Applicant: HME, Incorporated, Wyoming, MI (US)

(72) Inventors: Kenneth C. Lenz, Jr., Hudsonville, MI (US); Kevin J. Longhurst, Grand Rapids, MI (US)

(73) Assignee: HME, Incorporated, Wyoming, MI (US)

( * ) Notice: Subject to any disclaimer, the term of this patent is extended or adjusted under 35 U.S.C. 154(b) by 119 days.

(21) Appl. No.: 16/156,468

(22) Filed: Oct. 10, 2018

(65) Prior Publication Data

US 2020/0114184 A1 Apr. 16, 2020

(51) Int. Cl.
*A62C 27/00* (2006.01)

(52) U.S. Cl.
CPC ..... *A62C 27/00* (2013.01)

(58) Field of Classification Search
CPC ..... A62C 27/00
USPC ..... 169/24, 13
See application file for complete search history.

(56) References Cited

U.S. PATENT DOCUMENTS

| | | | | |
|---|---|---|---|---|
| 5,327,988 | A | 7/1994 | Lenz et al. | |
| 7,530,404 | B2 | 5/2009 | Lenz, Jr. | |
| 7,784,554 | B2 * | 8/2010 | Grady | A62C 27/00 169/13 |
| 9,265,979 | B2 | 2/2016 | Lenz, Jr. et al. | |
| 9,302,129 | B1 * | 4/2016 | Betz | E06C 5/04 |
| 9,399,151 | B1 * | 7/2016 | Combs | A62C 37/00 |
| 9,677,335 | B2 | 6/2017 | Lenz, Jr. et al. | |
| 9,751,459 | B1 | 9/2017 | Lenz, Jr. | |
| 9,757,601 | B2 | 9/2017 | Lenz, Jr. et al. | |
| 9,782,613 | B1 | 10/2017 | Lenz, Jr. | |
| 9,968,811 | B2 | 5/2018 | Lenz, Jr. et al. | |
| 2017/0050063 | A1 * | 2/2017 | Shively | A62C 27/00 |
| 2018/0222484 | A1 * | 8/2018 | Shively | B60K 6/08 |

OTHER PUBLICATIONS https://www.fireapparatusmagazine.com/articles/print/volume-19/issue-7/features/wildland-urban-interface-apparatus-assuming-larger-role-in-many-department-fleets.html, downloaded Sep. 7, 2018.

* cited by examiner

*Primary Examiner* — Alex M Valvis
(74) *Attorney, Agent, or Firm* — Warner Norcross + Judd, LLP

(57) ABSTRACT

A wildland urban interface (WUI) firefighting apparatus is provided in the form of a four-wheel or all-wheel drive pumper truck that merges the high-clearance and off road capability of a Type 3 wildland pumper truck with the functionality, exceptional handling, mobility and storage capacity of a Type 1 pumper truck. The truck can include a short front overhang chassis yielding a 20+ degree angle of approach and an optional 20+ degree angle of departure. The truck can include a compact water distribution system including a narrow discharge manifold plumbed to an engine PTO driven primary pump and optional portable secondary pump, which can operate during pump and roll firefighting procedures. The discharge manifold can be coupled to electronic valves operated via a control panel, and can be so narrow that it can contribute to shortening the truck's wheelbase.

15 Claims, 8 Drawing Sheets

WILDLAND URBAN INTERFACE FIREFIGHTING APPARATUS

BACKGROUND OF THE INVENTION

The present invention relates to a firefighting apparatus, such as a fire truck or other vehicle, and more particularly, to a firefighting apparatus including capable of deployment in both wildland and urban environments with substantial firefighting capabilities in both.

Fire engines are typically highly specialized to traverse and function in particular environments and firefighting scenarios. Accordingly, different fire engines come with different drives, tank capacities, pump flow rates and hose types. Due to these differences, pumper fire engines are categorized as certain types or classes, and fire departments will purchase a particular truck or engine based on their local environment, terrain and typical firefighting needs.

One type of pumper truck is classified as a Type 1 fire engine. This type of truck is used by fire departments in metropolitan areas and cities because it is specifically designed for structural firefighting, and is capable of deployment at residential homes, apartment complexes, businesses, commercial facilities, high rise buildings and other structures. Type 1 trucks usually include a pump that operates at 1000 GPM, a 400 gallon tank, multiple sets of different diameter hose, 20 plus feet of ladder (non-anal) and a 500 GPM Master Stream. Due to their use in urban environments, the trucks are rather large (with cab seating for four to six firefighters), are two-wheel drive, and have significant forward overhangs due to the cab size and the front bumper, such that angles of approach and departure are usually less than 15 degrees. Again, these are rather large, heavy trucks designed for deployment at easily accessible structural fires in urban environments.

Another type of pumper truck at the other end of the fire engine classification is a Type 3 pumper truck. This type of truck usually is much smaller than a Type 1 truck, and is used by fire departments mostly for vegetation or wildland fires, rather than structural fires. Type 3 trucks also can respond to emergencies in the back country where the heavier, larger and less maneuverable two-wheel drive Type 1 trucks cannot respond. Most Type 3 trucks include a smaller pump that operates at 150 GPM, a 500 gallon tank and multiple sets of different diameter hose. This allows the engines to make "running attacks" on vegetation fires by having a firefighter walk the edge of a fire with a hose line and the engine trailing close behind.

The Type 1 and Type 3 pumper trucks each serve particular firefighting needs in different terrains and environments. Some departments will own and use both trucks, depending on the locality and department. While this works well for large departments with significant budgets, smaller departments with fewer resources sometimes are forced to choose between the different pumpers. In some cases, these departments can be left with a less than optimal piece of equipment to fight fires in their community. In extreme situations, this can lead to unneeded fire damage, compromised firefighter safety and/or loss of life.

Accordingly, there remains room for improving firefighting vehicles to be capable of deployment in a variety of environments and terrain, and for addressing different types of fires.

SUMMARY OF THE INVENTION

A wildland urban interface (WUI) firefighting apparatus is provided in the form of a four-wheel or all-wheel drive pumper truck that merges the high-clearance and off road capability of a Type 3 wildland pumper truck with the functionality, exceptional handling, mobility and storage capacity of a Type 1 pumper truck.

In one embodiment, the pumper truck includes a short front overhang chassis yielding a 20+ degree angle of approach, an optional 20+ degree angle of departure. With such angles, the four-wheel or all-wheel drive vehicle is well suited to traverse a variety of varied and rugged off road terrain, yet still capable of travel on regular streets and roads to combat structural fires.

In another embodiment, the pumper truck can include a primary pump capable of at least 1000 GPM, a secondary combustion engine pump capable of at least 100 GPM, and a water tank capable of holding at least 500 gallons mounted to the chassis. The primary pump can be run off a power take off coupled to a power train of the truck, and can operate when the truck is stationary. The combustion engine pump can be mounted to the chassis, or atop a body on the chassis, and can run to pump water or firefighting liquid while the truck is moving to provide pump and roll firefighting capabilities.

In still another embodiment, the pumper truck can include a cab mounted on the chassis forward of a body mounted on the chassis. The cab can be over a front axle and wheels, and the body over a rear axle and wheels. The body can be separated from the cab by less than 30 inches so that the wheelbase is condensed to the less than 160 inches for the pumper truck which can give the truck enhanced maneuverability and climbing capabilities.

In even another embodiment, the body includes an upper deck mounted above the tank. The upper deck can be outfitted with a foam and deck gun to provide enhanced structural protection and firefighting capability. The deck gun can apply liquid, such as water, from atop the truck over and out from the lateral sides, the front and/or the rear of the truck.

In a yet another embodiment, the pumper truck can be outfitted with one or more hose reels, optionally mounted to the upper deck of the body. The truck can include a first hose reel with a first hose in communication with the tank. The first hose reel can be mounted to the body and configured to enable deployment of the first hose from the body from a first lateral truck side. The truck also can include a second hose reel with a second hose in communication with the tank. The second hose reel can be mounted to the body and configured to enable deployment of the second hose from the body from a second lateral truck side. Thus, the pump and roll capability of the truck can be enhanced.

In a further embodiment, the pumper truck can include a water distribution system with selectively placed inlets and discharge outlets about the truck, all plumbed to a compact discharge manifold in liquid communication with the primary pump and/or the secondary pump, as well as selectively in liquid communication with the inlets and/or discharge outlets via multiple manifold valves, controlled by a controller.

In still a further embodiment, the pumper truck can include a first liquid discharge outlet in communication with the discharge manifold and operative to discharge liquid via a first electronic manifold valve coupled to the control panel. The first liquid discharge can be located on the first lateral truck side. The truck can include a second liquid discharge in communication with the discharge manifold and can be operative to discharge liquid via a second electronic manifold valve coupled to the control panel. The second liquid discharge can be located on the second lateral truck side. The truck can include a third liquid discharge in communication with the discharge manifold and can be operative to discharge liquid via a third electronic manifold valve coupled to the control panel. The third liquid discharge can be located on the rear of the truck. The truck can include a fourth liquid discharge in communication with the discharge manifold and can be operative to discharge liquid via a fourth electronic manifold valve coupled to the control panel. The fourth liquid discharge can be located on the rear, distal from the third liquid discharge.

In yet a further embodiment, the discharge manifold and the associated electronic valves can be mounted to the chassis and in communication with the primary pump. The discharge manifold can be substantially vertical, such that its front to back thickness is less than its height. In some cases, the thickness can be less than half its height. Indeed, particular ratios can be selected depending on the application, the intended wheelbase of the truck, and/or the configuration of the manifold and its placement on the truck. For example, the ratio of the overall height of the manifold and valves (or the compartment within which those components are housed) to the front to back thickness of these components can be optionally greater than 2.1:1, further optionally greater than 2.25:1, yet further optionally greater than 2.5:1, even further optionally greater than 3:1, still further optionally greater than 4:1, yet further optionally greater than 5:1, still further optionally between 2.1:1 and 5:1, inclusive, even further optionally between 2.25:1 and 4:1 inclusive, yet further optionally between 2.1:1 and 3:1, inclusive. With such optional ratios for its noted dimensions, the discharge manifold with electronically operated valves can be minimized so that the wheelbase of the pumper truck can be shortened. Further, the discharge manifold can eliminate wasted space on the truck and can create more storage space for equipment and/or crew members gear.

In even a further embodiment, the pumper truck includes a cab and a body distal from the cab. The cab and body can have a substantially vertical discharge manifold disposed therebetween. The discharge manifold can be substantially taller than it is wide so that the cab and body can be disposed optionally less than 36", further optionally less than 30", yet further optionally less than 24" from one another to shorten the wheelbase of the pumper truck. A compartment within which the discharge manifold is located can be of corresponding dimensions.

In another embodiment, the body can include a storage unit that defines a compartment rearward of the discharge manifold. The compartment can include an opening. Inside the compartment, a control panel can be disposed. The control panel can be in the form of a touch screen control panel, operable to control and/or monitor the discharge valves and other components of the truck. The control panel can be in electrical communication with the discharge valves, via a direct hard wire and/or wirelessly, via Bluetooth, WiFi or a network. In some cases, the control panel can be removable from the truck and transportable in the general vicinity of the truck. This can provide remote operation of the components of the truck. With the control panel, less space is consumed on the truck, leaving more room for crew and other equipment. Such a control panel can enable operation of the manifold and the onboard pumps, inside the cab or outside the truck, for greater efficiency and improved operator safety.

The current embodiments provide a simple and effective pumper truck that is capable as a Type 1 and as a Type 3 fire engine. With such a construction, departments can purchase a single truck for addressing a variety of deployments in wildlands and in urban settings to address structural fires. This can conserve resources yet still outfit departments with the equipment to protect their community.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
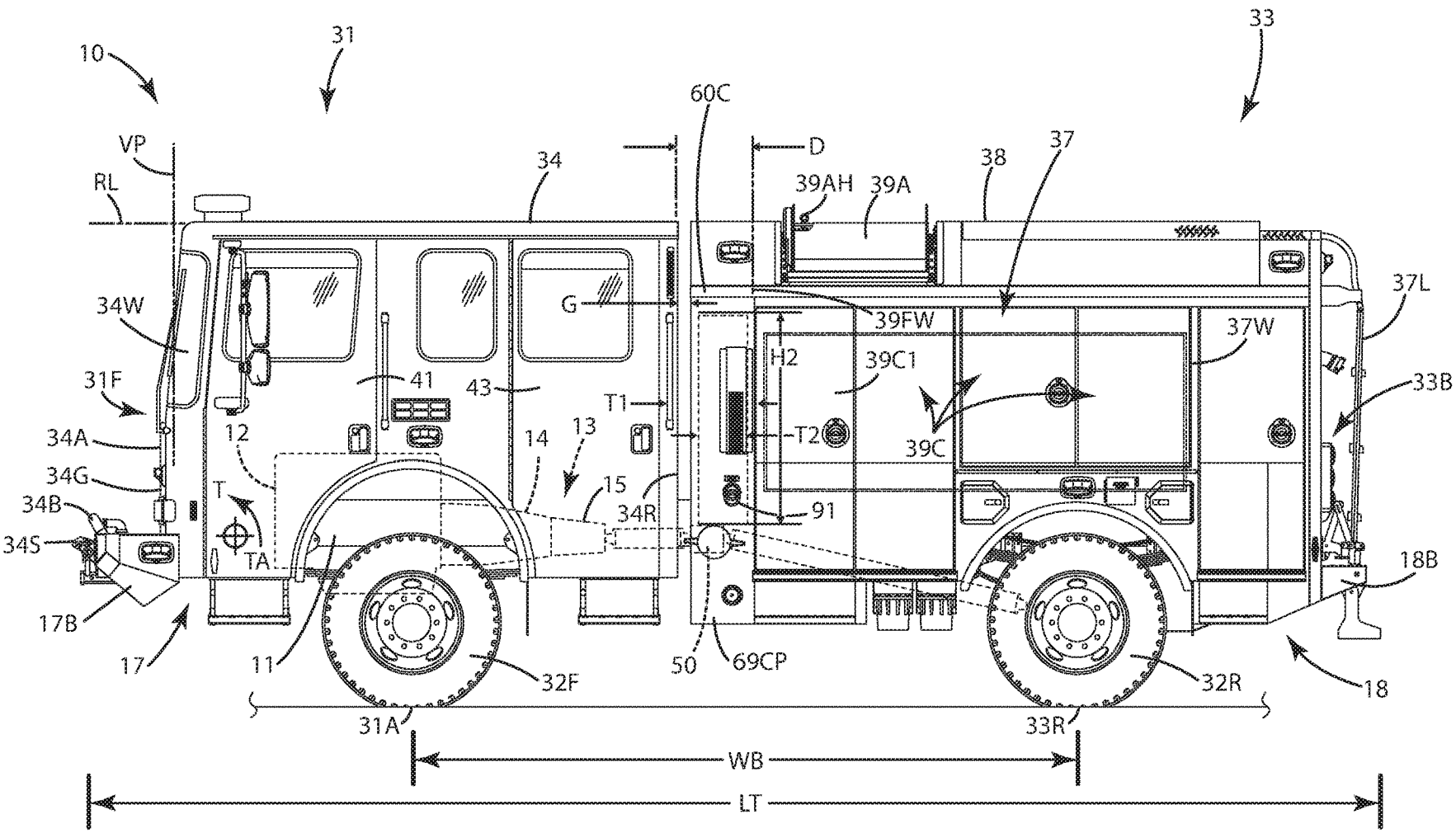
FIG. 1 is a left side view of a firefighting apparatus in the form of a pumper truck according to a current embodiment.

A current embodiment of a firefighting apparatus is illustrated in FIGS. 1-8 and generally designated 10. As shown, the firefighting apparatus can be in the form of a pumper fire truck that is configured to pump large volumes of firefighting fluid from a fluid source, optionally an on board tank, through one or more fire hoses, onto a fire to extinguish or suppress the fire, whether a vegetation fire or a structural fire. Although referred to as a firefighting apparatus, as used herein, that term can also include a variety of emergency vehicles, rescue vehicles and other modes of transportation such as aerial ladder trucks, trailers or other equipment. Generally, the apparatus, also referred to herein as a fire truck, can be a self-propelled and mobile vehicle.

The fire truck 10 can include a chassis 11 to which a cab 34 and a body 37 are mounted. The chassis 11 can be mounted to a front axle 31A and a rear axle 33A. Although shown with a single rear axle 33A, the apparatus or truck described herein can include multiple rear axles. The chassis can include an engine 12 connected to a drivetrain 13, including a transmission 14 and a transfer case 15. The engine can be an internal combustion engine such as a diesel or gas engine. The engine can include a power take off PTO joined with a primary pump 50 as described below. The transfer case 15 can be a multi-speed case, such as a two-speed case, to provide low range during off road use of the truck 10. The drivetrain 13 can provide movement, and power the front and rear axles so that the truck is 4×4, or all-wheel-drive, with power to the rear wheels 32R as well as the front wheels 32F via the drivetrain. The wheels can all be equipped with super singles off road capable tires, but of course, in some applications, the rear wheels can be dual wheels on each side. Optionally, where there is an additional rear axle, another set of wheels and tires can be included on the truck, and such can be powered by the drivetrain as well for additional traction and mobility.

Further optionally, the front and rear axles 31A and 33R can be separated from one another so that the truck 10 and chassis 11 have a wheelbase WB that is rather short for such a large vehicle. As an example, the wheelbase WB can be optionally less than 175 inches; further optionally less than 160 inches; yet further optionally less than 155 inches; still further optionally less than 150 inches; further optionally between 120 inches and 160 inches inclusive; and even further optionally between 145 inches and 150 inches. As explained below, the wheelbase WB can be shortened via a particular discharge manifold. The truck also can have a width W. The width can span from one side of the truck to the other, generally between the side panels on those sides, not including the side accessories like mirrors, lights, ladders, etc. The wheelbase and width can also be selected to suit the particular application of the current embodiments. For example, the ratio of the wheelbase WB to the width W optionally can be less than 2:1; further optionally 1.8:1; yet further optionally less than 1.7:1; further optionally between 1.8:1 and 1.5:1, inclusive; still further optionally between 1.8:1 and 1.6:1, inclusive.

The fire truck 10 can include one or more internal electronic or computer controls that can operate the engine, transmission, or steering control mechanism to enable the front wheels to be steered upon transport to an emergency location. As used herein, an emergency location or emergency scene can be a scene of a fire, an area with harmful, hazardous, toxic and/or carcinogenic chemicals present, an area of a chemical spill or discharge of any type, a traffic accident, a boating accident, a plane accident, a man-made or natural disaster, and/or a terrorist attack, or any other location where one or more lives or property are endangered or otherwise compromised.

The fire truck 10 can include a forward portion 31 and a rearward portion 33 located at opposite ends of the fire truck 10. The forward portion 31 can include the cab 34 mentioned above. The cab 34 can house occupants, such as firefighters, emergency responders, rescue personnel, or other personnel as they are transported to and from an emergency location. The cab 34 can include conventional controls, such as a steering mechanism and various displays inside the cab to monitor and evaluate the operation of the vehicle 10. The cab also can include a control panel to operate the pumps and discharge manifold. The cab can include a number of seats for the occupants, and can be the portion of the fire truck where the occupants enter and sit in the fire truck for transport. Optionally the cab can be configured to seat at least two, four, six or more occupants. The cab can terminate a distance of several feet rearward of the front wheels 32F, or generally forward of the discharge manifold and/or rearward portion 33 of the fire truck 10. The fire truck 10 can include one or more doors 41, 43 that offer ingress and egress into the interior of the cab 34.

The cab 34 can include a front 31F of the truck 10. The cab 34 can be a flat front cab as shown. The panels 34A, grill 34G and windshield 34W can be substantially vertical and can lay in or generally parallel to a vertical plane VP. The cab 34 also can be a tiltable cab, such that the cab 34 can tilt forwardly in direction T, thereby rotating about a tilt axis TA in which the cab is rotatably and/or otherwise pivotally joined with the chassis 11. Of course, in other applications (not shown), the cab might not be tiltable, and the cab can include a nose that projects over and includes a hood to cover the engine of the truck 10.

The rearward portion 33 can include a body 37 that is described further below. The body can include a rear 33B of the truck. The body can be separated from the cab 34 as explained further below, by a short distance D, so the wheelbase is condensed. Optionally, this distance D can be optionally less than 30 inches; further optionally less than 28 inches; yet further optionally less than 25 inches; even further optionally less than 24 inches; and yet further optionally between 10 inches and 30 inches inclusive. Again, this can assist in condensing the wheelbase to the values mentioned above.

The rearward portion 33 can include rear wheels 32R and the associated rear axle 33A, which can be located under the body optionally in the rearward half of the length LT of the fire truck 10. The front or steering wheels 32F can be located in the forward portion 31 of the fire truck, mounted via a front axle 31A. The front wheels 32F can be located under the cab, optionally in the forward half of the length LT of the fire truck 10.

As mentioned above, the wheels 32F and 32R can be mounted on the front axle 31A and a rear axle 33A. The front axle 31A can be located in the forward portion 31, under the cab 34, and the rear axle can be located in the rearward portion 33. The front axle can include a steering system to enable the front wheels to be steered. The front wheels and steering system can be configured on a steering system having an extreme tight-turn radius which allows the truck to negotiate rugged roads, twisting two-tracks and mountain trails.

Figure 3:
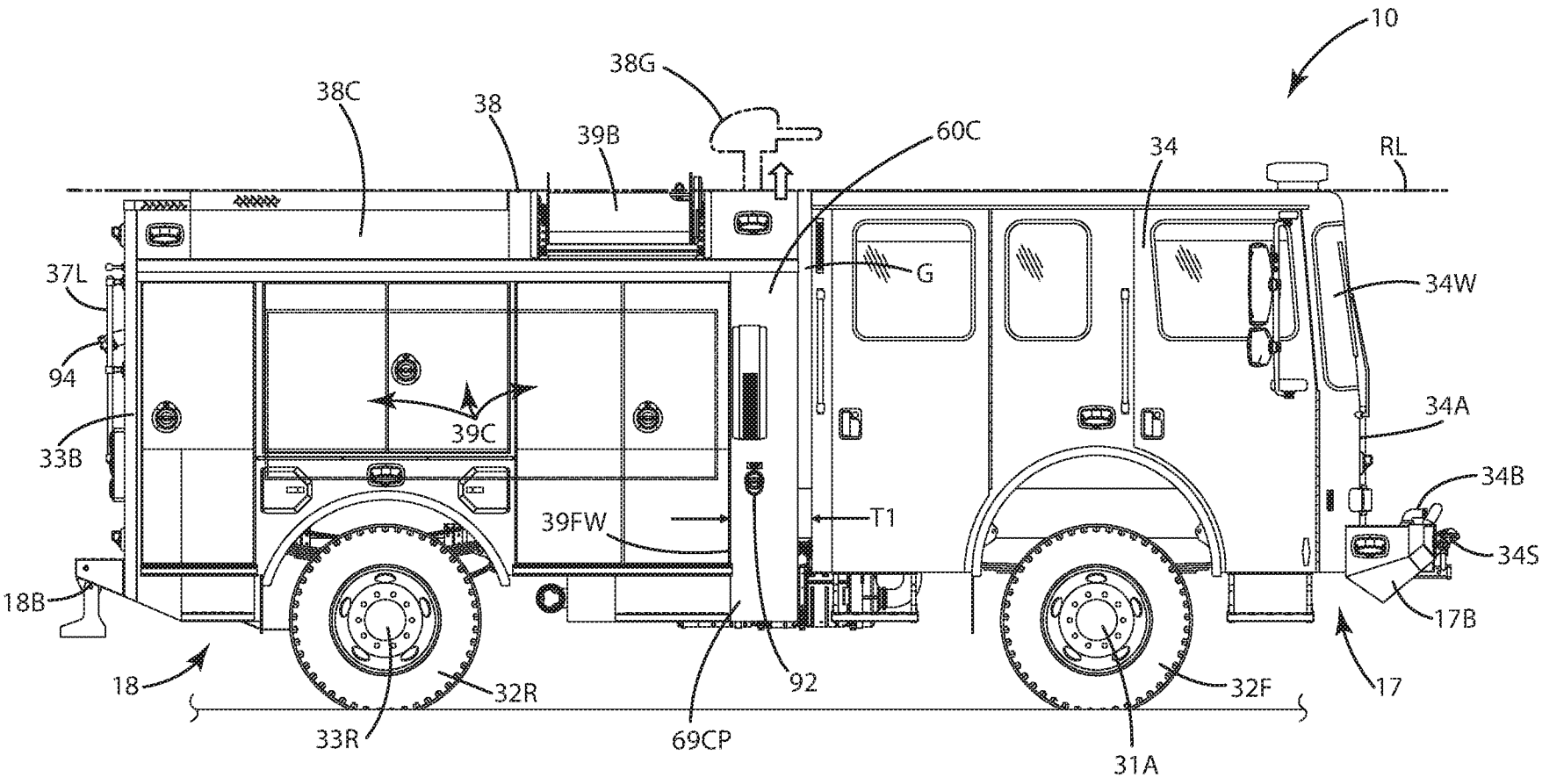
FIG. 3 is a right side view of the apparatus.
Figure 4:
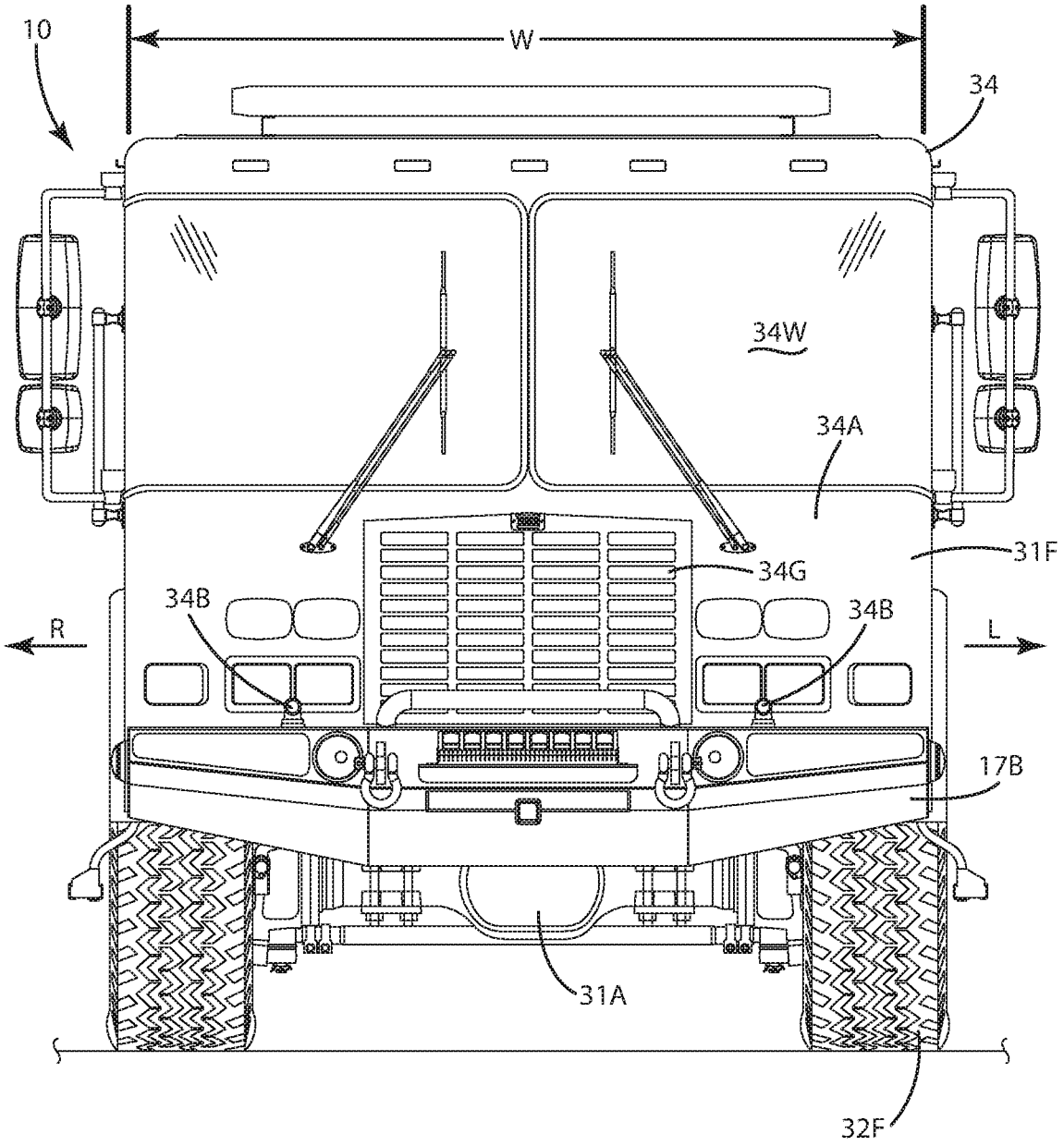
FIG. 4 is a front view of the apparatus.

As shown in FIGS. 1 and 3, the chassis 11 can include a front overhang 17 that extends forward of the front axle 31A. The front overhang extends under the cab 34 and can be joined with or otherwise terminate at a bumper guard 17B that lays forward of the front panel 34A in the grill 34G of the cab 34. This front can be a short front overhang such that when combined with the bumper guard 17B, the chassis 11 has an angle of approach optionally between 20° and 40° inclusive; still further optionally between 20° and 30°, inclusive; further optionally between 22° and 30°, inclusive; further optionally between 22° and 26°, inclusive; and yet further optionally about 22°. The chassis 11 also can include a rear overhang 18 that extends rearward of the rear axle 33R. The rear overhang extends under the body and can be joined with or otherwise terminate at a rear bumper guard 18B that lays rearward of the rear 33B of the body and truck in general. This can be a short rear overhang such that when combined with the rear bumper 18B, the chassis 11 has an angle of departure optionally between 22° and 40° inclusive; further optionally between 22° and 30° inclusive; yet further optionally between 24° and 28°, inclusive; and still further optionally about 26°.

Figure 2:
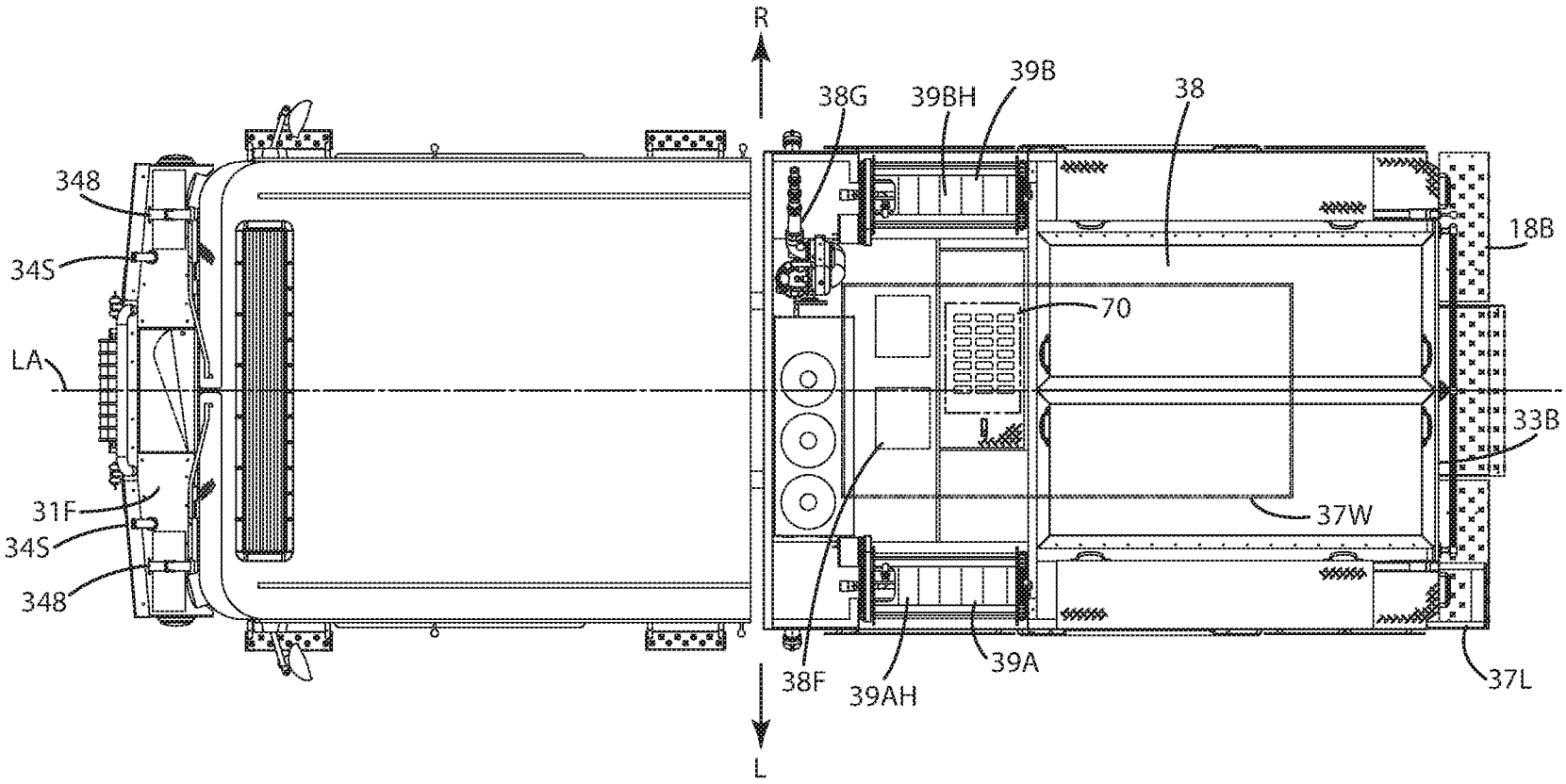
FIG. 2 is a top view of the apparatus.
Figure 5:
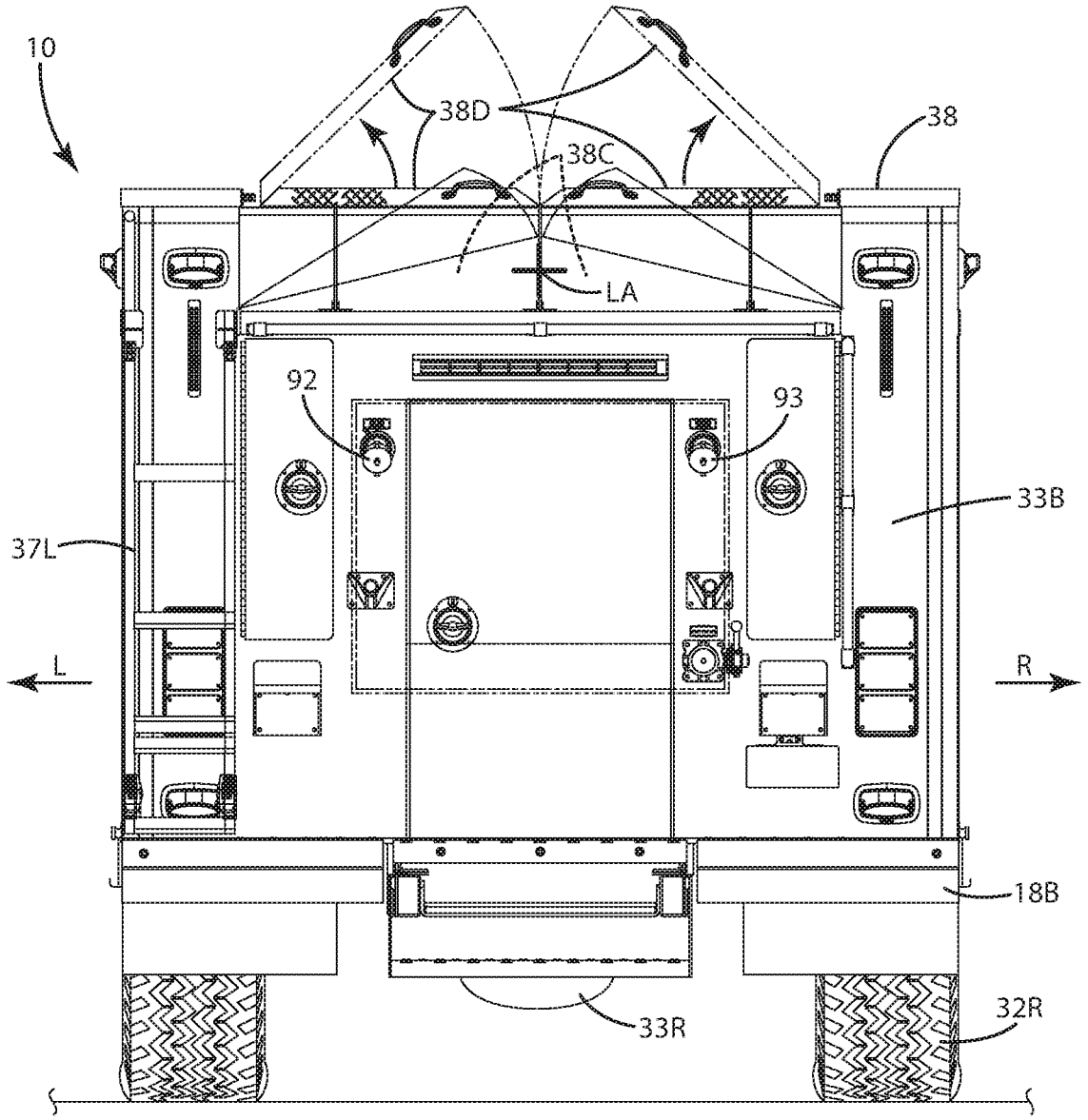
FIG. 5 is a rear view of the apparatus.

As shown in FIGS. 1, 2 and 5, the body 37 can include an upper deck 38. Upper deck 38 can be mounted above the water tank 37W is concealed generally within the body 38. The upper deck 38 can be relatively flat and void of obstacles or protrusions that can produce a tripping hazard. The upper deck 38 can be accessed via a rear egress ladder 37L that extends generally from the rear bumper 18B upward toward the upper deck 38. The upper deck 38 can be all hard covered, for example, with metal and/or composite panels. As shown in FIG. 5, the deck 38 can include and be formed at least partially with doors 38D that fold and open outwardly away from the longitudinal axis LA of the truck 10. These doors can offer access to other compartments 38C where gear, hoses and other equipment can be stored. Generally, the entire upper deck and all the other components of the upper deck can be constructed from hardcover materials as mentioned above to keep burning embers out of the hose beds and other compartments containing personal gear for the crew.

The upper deck 38 can be accessed via a rear egress ladder 37L that extends generally from the rear bumper 18B upward toward the upper deck 38.

Optionally, the upper deck can be outfitted with a deck gun 38G rotatably mounted thereto. The gun 38G can be pivotable so that the liquid, such as water, can be shot from atop the body 37 in multiple directions. For example, water can be applied from the first lateral side L, the second lateral truck side R, the front 31F and/or the rear 33B of the truck. This deck gun also can be configured to extend above the upper deck 38, and/or be retracted below the upper deck 38. For example, as shown in FIG. 1, the deck gun 38G does not project above the upper deck 38; however in FIG. 3, the deck gun can be extended and moved upward so that it does project above the roof line RL. The deck gun can be retracted below the roof line RL for improved clearance when not in use at an emergency location.

The body 37 can be outfitted with first 39A and second 39B hose reels as shown in FIG. 2. These hose reels can be disposed below the roof line RL, but generally accessible from the upper deck 38. The first hose reel can include a first hose 39AH, while the second hose reel can include a second hose 39BH. Each of these hoses can be in communication with tank 37W and more generally to the pumps 50 and/or 70, and the discharge manifold 60 as explained below. The hose reels can be configured so that the respective hoses can be spooled off the reel and a firefighter can walk alongside her adjacent the truck 10 while it is in motion to provide pump and roll capabilities.

To provide this pump and roll capability, the truck can include a secondary pump 70 that is in communication with the discharge manifold 60 and the respective hose reels 39A and 39B, as well as other hoses or lines that will be described below. The secondary pump 70 can be mounted directly below the upper deck 38, optionally above the water tank 37W. The secondary pump can be a combustion operated pump, such as a diesel or gasoline pump. This pump also can be disposed below the roof line RL to improve clearance. The pump can be generally centrally located, laying over a portion of longitudinal axis LA of the truck and over the tank 37W. The hoses and the reels can be in fluid or liquid communication with the secondary pump and capable of pumping liquid so that the pump can pump liquid from the tank through the first and second hoses while the truck is rolling over terrain in a pump and roll mode. As mentioned below, the secondary pump also can be in liquid communication with the discharge manifold 60 and the respective reels and other outlets.

The discharge manifold 60 can be operated by the control panel 80 to achieve a pump and roll mode. In this pump and roll mode, water or other liquid from the tank 37W can enter the discharge manifold 60 and can be communicated to one of the multiple manifold valves operated by the control panel to the secondary pump 70, but not the primary pump. In this manner, the secondary pump pumps the liquid under pressure to the respective outlets and other lines all while the truck is moving. Secondary pump can be capable of pumping liquid at a rate of at least 100 gallons per minute (GPM); further optionally at a rate of at least 150 GPM; yet further optionally at a rate of at least 200 GPM; and yet further optionally between 100 GPM and 200 GPM, inclusive. Alternatively, the discharge manifold 60 respective valves can be operated by the touch screen to achieve a stationary mode. In the stationary mode, water or other liquid from the tank 37W enters the discharge manifold 60 and is communicated via one or more of the outlets and/or hoses associated with a reel while the truck is stationary. In the stationary mode, the secondary pump can be off and the primary pump 50 can be on conveying the liquid. When in the stationary mode, and the truck is being utilized to combat a structural fire, the primary pump can pump liquid to the manifold, and the discharge manifold 60 can discharge liquid via a respective manifold valve associated with and controlled by the control panel to a particular liquid discharge outlet optionally located on the first or second lateral truck sides, front and/or the rear of the truck as described further below.

The secondary pump optionally can be in liquid communication with optional front bumper lines 34B to which hoses can be joined to further provide pump and roll capabilities. In some cases, the truck can be outfitted with additional lines on the lateral sides of the truck, as well as rear lines so that hoses can be connected to those in a pump and roll function. In some cases, the secondary pump also can be in liquid communication with first and second 34S ground sweep sprayers mounted to the bumper guard 17B. These ground sweep sprayers can be configured to spray liquid forward of the front 31F the truck. The sprayers can be utilized to protect the truck when traversing regions where embers or vegetation on fire exists.

Optionally, the truck can be outfitted with a foam tank 38F adjacent the upper deck. This foam tank can contain a supply of foam used for firefighting in certain activities. This foam tank also can be in liquid communication with the discharge manifold, the primary pump and/or the secondary pump, both of which are also in liquid communication with the discharge manifold. The foam tank can have a compartment capacity of optionally 30 gallons; further optionally 50 gallons; yet further optionally between 10 gallons and 100 gallons, inclusive.

The body 37 also can include compartments 39C mounted rearward of the cab in the rearward portion 33 of the fire truck 10 on one or both lateral sides R or L which are disposed on opposite sides of the longitudinal axis LA that extends generally along the length of the truck, optionally bisecting it as shown in FIGS. 1-3. These compartments can be located on and accessible from the respective first side R or the second side L of the fire truck 10, and can be sized and configured to store supplies and equipment useful for easy access at an emergency location. Generally, the compartments can be sized such that they do not extend across the longitudinal axis LA of the truck from one side to the other. Put another way, the compartments generally can be shallower than one half the width W of the truck, which extends from one side of the truck to the other. Multiple lockers or compartments can fill a substantial portion of the lateral sides of the truck of the body. Some compartments can be mounted forward of the rear axle, some over the rear axle, and some rearward of the rear axle. Further optionally, the compartments associated with the body can be rearward of the front axle and rearward of the cab 34.

Figure 6:
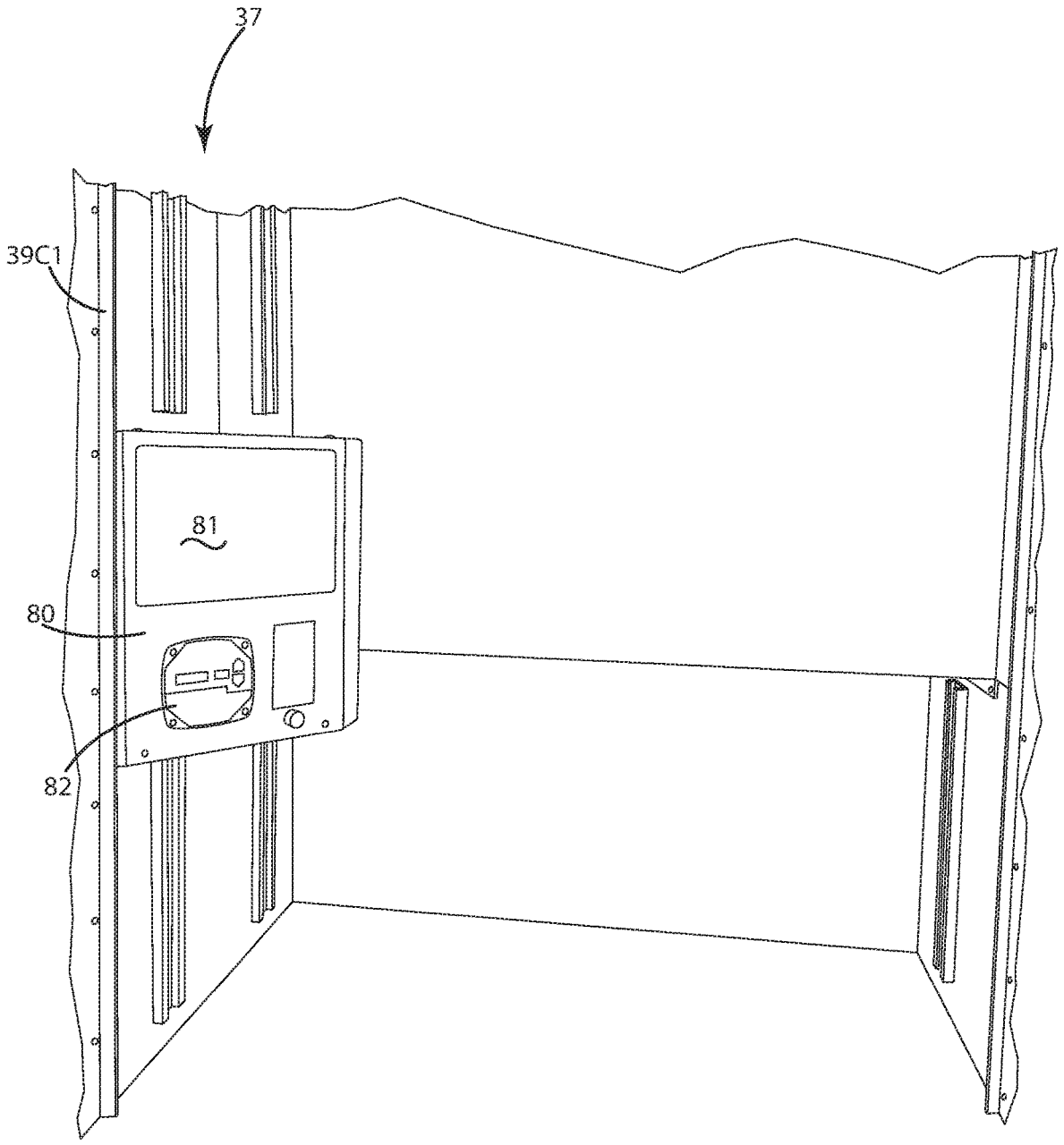
FIG. 6 is side view of a compartment of a body of the apparatus opened to expose a control panel therein, configured to control a discharge manifold and the discharges of the apparatus.

The discharge manifold 60 and the pumps 50 and 70 can be operated via a control panel 80. As illustrated in FIG. 6, the control panel 80 can be mounted in a compartment 39C of the body 37. This panel can include some input controls 82 and a screen 81 displays various components that it controls, as well as the status of operation of those components. The control panel 80 can take up a very small portion of the compartment 39C such that the remainder of the compartment 39C1 can be utilized to store equipment, gear or other items. Of course in other applications, the control panel can be mounted in the cab 34, or alternatively, multiple control panels can exist on the truck, for example, one in the cab and another in a compartment on the body. The control panel 80 can be in the form of a manually operated panel with multiple buttons, switches or other manually operated controls. However, as shown, the control panel 80 in FIG. 6 can also be a touch screen control panel having all associated pump controls and electronic valve controls displayed on the screen. This control panel can be operated via just a touch of the finger, inside the cab or outside the cab or truck, or even remotely from the truck. This control panel can be electrically hardwired or directly connected to the multiple manifold valves as described below. This touch panel can be in communication with the different components via a hardware, and wired directly to the components that way. Alternatively, the control panel can be in communication with the components via a wireless connection, such as Bluetooth, WiFi or a network or other transmittable signal. Where there is a wireless connection between the control panel and the components, that control panel optionally can be removable from the truck 10 so that a user can operate the pumps, manifold and valves or other components remotely from the truck, while being located at a distance from the truck.

Figure 7:
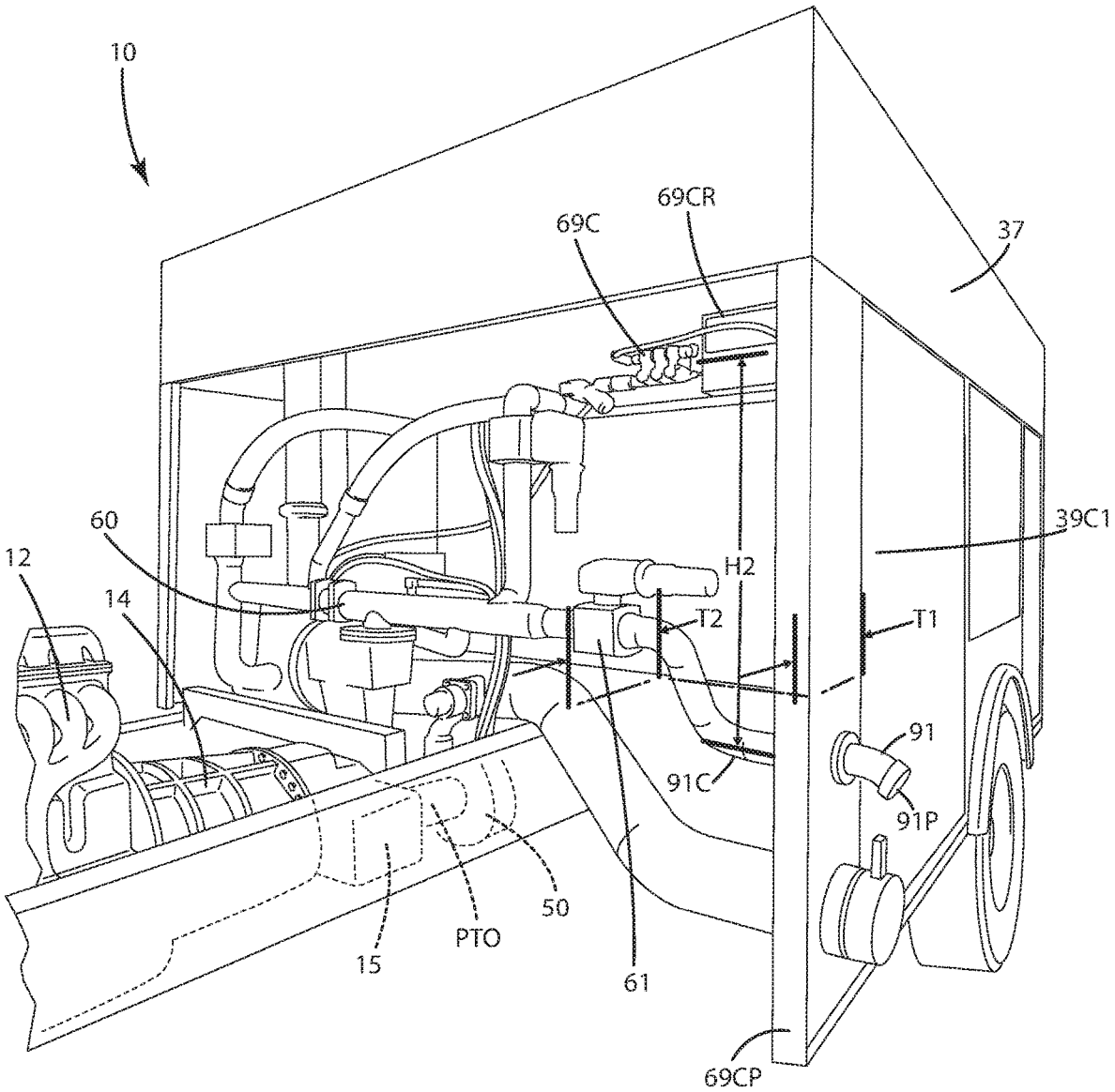
FIG. 7 is a side perspective view of the discharge manifold and pump of the apparatus, with a cab of the truck tilted upward to provide exposure to such components.

As shown in FIGS. 1 and 7, the truck 10 can include a pump 50 that is in the form of a primary pump. This primary pump can be operated to pump liquid into the discharge manifold 60 and otherwise provide pump liquid at a particular flow rate out of the various discharge outlets and lines associated with the truck and described above. The pump 50 can optionally be a 1500 GPM midship pump, which can be supplemented with a 150 GPM auxiliary or secondary pump 70 for pump and roll capabilities as described above. The primary pump 50 can be mounted between the cab and the body of the truck, and/or slightly below one or the other or both, within the chassis. The pump can be mounted via brackets to the chassis. The pump can be further coupled to the transfer case 15 or otherwise to the drivetrain 13 of the truck via a PTO. As mentioned above, the engine can run the PTO to operate the primary pump 50 while the truck is stationary, and which the pump and discharge manifold operate in a stationary mode. Depending on the application, the pump can vary. For example, the pump can be capable of pumping liquid optionally at a rate of at least 1000 GPM; further optionally at a rate of at least 1200 GPM; yet further optionally at a rate of at least 1500 GPM; and even further optionally at a rate of at least 2000 GPM; yet further optionally between 1000 GPM and 1750 GPM, inclusive. Other sized primary pumps can be selected, depending on the application, the engine rating, and the type of truck to be utilized. Generally however, a higher GPM pump, in excess of 1000 GPM can be utilized with the fire truck 10 so that is capable of deployment and use in both wildland firefighting activity, as well as for structural protection, to provide long powerful streams of liquid to reach structures located a far distance from the firefighter and/or the truck.

Figure 8:
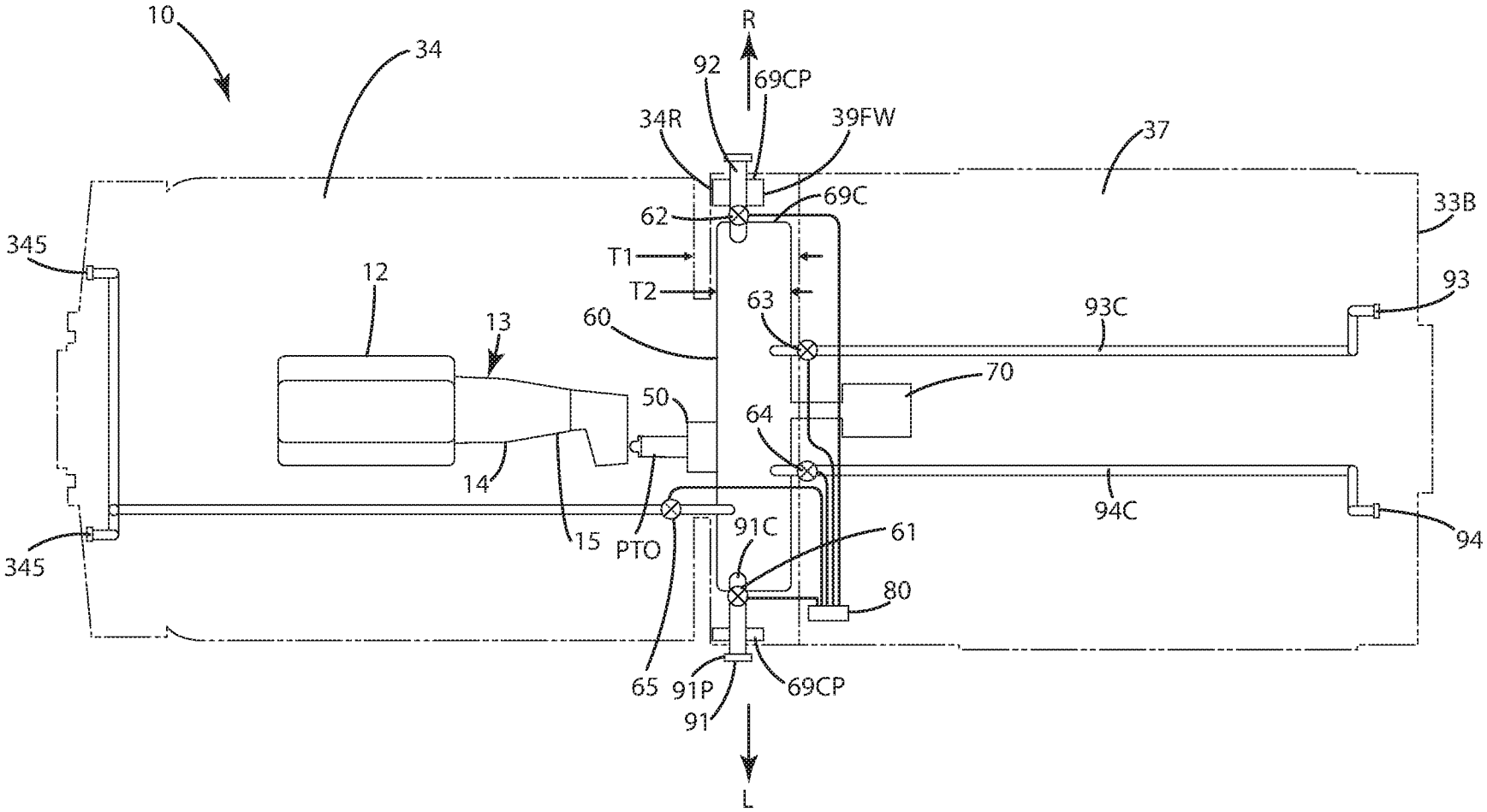
FIG. 8 is a schematic of the discharge manifold, valves and various discharge outlets.

As illustrated in FIG. 7, the primary pump 50 can be joined with and in liquid communication with the discharge manifold 60. This discharge manifold is outfitted with multiple manifold valves that are each in communication with the control panel 80 that is operable by a user of the apparatus. The discharge manifold 60 can be mounted substantially vertically within the compartment 69C that is located between the cab and the body. This compartment can be formed by the rear wall 34R of the cab and a front wall 39FW of the body. This compartment 69C can be flanked on the lateral sides L and R by respective panels 69CP that generally close off the compartment 69C within which the discharge manifold 60 is located. This compartment, the discharge manifold and its components, can be taller than it is thick, from front to rear, taken along a thickness parallel to the longitudinal axis LA. For example, as shown in FIGS. 7 and 8, the compartment 69C can have a thickness T1, and the cab and body can be disposed that thickness from one another optionally less than 36"; further optionally less than 30"; yet further optionally less than 24" from one another to shorten the wheelbase of the pumper truck.

In some applications, the compartment 69C can be configured such that the side panels 69CP and the roof 69CR of the compartment 69C can be spaced a gap G from the rear wall 34R of the cab. This is so that heat buildup in the manifold and/or from the engine can escape through that gap G between the body and the cab.

The discharge manifold 60 can be substantially vertical, such that its front to back thickness T2 can be less than its height H2. In some cases, the thickness can be less than half its height. Particular ratios can be selected depending on the application, the intended wheelbase of the truck, and/or the configuration of the manifold and its placement. With a substantially vertical discharge manifold 60, the wheelbase of the truck can be substantially shortened. The front to back dimension or thickness T2 of the manifold can also be similar to that thickness T1 mentioned above for the compartment 69C. For example, the ratio of the overall height H2 of the discharge manifold (and/or optionally the compartment 69C within which those components are housed) to the front to back thickness T2 of the discharge manifold (and/or the compartment thickness T1) can be optionally greater than 2.1:1; further optionally greater than 2.25:1; yet further optionally greater than 2.5:1; even further optionally greater than 3:1; still further optionally greater than 4:1; yet further optionally greater than 5:1; still further optionally between 2.1:1 and 5:1, inclusive; even further optionally between 2.25:1 and 4:1, inclusive; and yet further optionally between 2.1:1 and 3:1, inclusive. The front to back thickness T2 of the discharge manifold can include its components, including for example, the large pipes and conduits that form the manifold itself, as well as the various valves, servos, couplings, motors, bolts, fittings, and other hand components that are attached to the discharge manifold. The ratio of the width W of the truck to the overall height H2 of the manifold can also be expressed as a ratio, for example optionally less than 2:1; further optionally less than 1.75:1; yet further optionally less than 1.5:1; yet further optionally between 2:1 and 1.5:1, inclusive; and still further optionally between 2:1 and 1:1, inclusive.

The discharge manifold 60, as mentioned above, can be in liquid communication with multiple liquid discharge outlets. For example, the manifold 60 can be in liquid communication with a first liquid discharge outlet 91 located on a first side L of the truck. This liquid communication can be in the form of a conduit 91C that leads from the manifold 60 to the outlet 91. The outlet can be covered with a cap 91P that can be removed and hooked up to a hose. Optionally, the discharge outlet can be a 2.5 inch discharge outlet, or other dimensions depending on the application. The conduit 91C can be in fluid communication with the discharge manifold 60, with a first electronic manifold valve 61 controlling the flow of liquid from the discharge manifold to the discharge outlet. This electronic manifold valve can be operated via a servo or an electric motor that is controlled by the control panel 80 as described above. The electric manifold valve 61 can include a butterfly valve check valve or other type of valve therein to control the flow of liquid therethrough, thereby controlling communication of liquid pressurized within the discharge manifold by the pump, out to the discharge outlet 91.

The other various liquid discharge outlets described below can have similar manifold valves and conduits associated with them, and those valves likewise can be coupled to the control panel, either hardwired or wirelessly so the control panel can control those valves and supply a particular desired flow to the respective discharge outlet. Those other liquid discharge outlets can include a second discharge outlet on the second lateral truck side, namely discharge outlet 92. This can be controlled by a second manifold valve 62 in communication with the control panel 80. Third and fourth liquid discharge outlets 93 and 94 can be disposed to the rear of the body 37 and generally located on the rear 33B of the truck as shown in FIG. 5. Again, these components can be coupled to conduits 93C, 94C and can be controlled by manifold valves 63, 64 which are further controlled by the control panel 80. In addition, the discharge manifold can be in liquid communication with the ground sweep sprayers 34S mounted to the front of the truck. These sprayers can be controlled to spray liquid therefrom via manifold valve 65, which is controlled by control panel 80. The control panel also can control the primary pump and secondary pumps connections to the discharge manifold. For example, when the truck is in the stationary mode, the control panel 80 can turn off the connection between the secondary pump in the manifold, allowing the primary pump to pressurize the discharge manifold. When the system is in the pump and roll mode, the control panel can be used so that the secondary pump can pressurize the manifold and distribute water accordingly to the respective supply lines and hoses for the pump and roll operation.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A firefighting apparatus comprising:

a chassis;

a drivetrain mounted to the chassis;

an engine mounted to the chassis and the drivetrain, the engine including a power take off joined with a primary pump, the primary pump capable of pumping liquid at a rate of at least 1000 GPM;

a discharge manifold mounted to the chassis and in fluid communication with the primary pump, the discharge manifold including a plurality of electronically controlled manifold valves, each in communication with a control panel operable by a user of the apparatus;

a front axle and a rear axle, joined with respective front wheels and rear wheels, each of the front wheels and rear wheels being powered by the drivetrain and configured to enable transportation of the apparatus to an off road emergency location, the front and rear axles separated such that a wheelbase of the chassis is less than 160 inches;

a front overhang of the chassis extending forward of the front axle, and a rear overhang extending rearward of the rear axle, the front overhang terminating at a bumper guard forward of the front wheels such that the chassis has an angle of approach between 20 degrees and 40 degrees inclusive, the rear overhang terminating at a rear bumper guard so that the chassis has an angle of departure between 22 degrees and 40 degrees inclusive;

a cab mounted to the chassis above the front axle and configured to house at least two occupants, the cab including a front of the apparatus;

a body located rearward of the cab, the body having an upper deck, the rear axle and rear wheels being located under the body, the body including a rear of the apparatus, the body separated from the cab by less than 30 inches so that the wheelbase is condensed to the less than 160 inches;

a tank mounted in the body and configured to store at least 400 gallons of liquid;

a side to side width extending across the body from a first lateral truck side to a second lateral truck side opposite the first lateral truck side;

a longitudinal axis extending from the cab toward the body;

a deck gun rotatably mounted on the upper deck and configured for application of water from atop the body over at least one of the first lateral truck side, the second lateral truck side, the front and the rear;

a first hose reel with a first hose in communication with the tank, the first hose reel mounted to the body and configured to enable deployment of the first hose from the body; and a combustion secondary pump mounted to the body and in fluid communication with the first hose, the secondary pump capable of pumping liquid from the tank through the first hose while the apparatus is rolling over terrain;

wherein the secondary pump is capable of pumping liquid at a rate of at least 100 GPM, wherein the secondary pump is mounted above the tank adjacent the upper deck.

2. The firefighting apparatus of claim 1, comprising:

a second hose reel with a second hose in communication with the tank, the second hose reel mounted to the body and configured to enable deployment of the first hose from the body, wherein the second hose is in fluid communication with the secondary pump, and capable of pumping liquid from the tank through the second hose while the apparatus is rolling over terrain.

3. The firefighting apparatus of claim 2, wherein the first hose reel is mounted atop the body so that the first hose is deployable from the first lateral truck side, wherein the second hose reel is mounted atop the body so that the first hose is deployable from the second lateral truck side.

4. The firefighting apparatus of claim 1, wherein the cab is forwardly tiltable relative to the chassis and away from the body so as to provide access to a combustion engine mounted under the cab, wherein the cab has a flat front that is substantially vertically oriented, wherein the cab is outfitted with at least four seats to transport at least four occupants.

5. The firefighting apparatus of claim 1, comprising:

a first liquid discharge outlet in communication with the discharge manifold and operative to discharge liquid via a first electronic manifold valve coupled to the control panel, the first liquid discharge outlet being located on the first lateral truck side;

a second liquid discharge outlet in communication with the discharge manifold and operative to discharge liquid via a second electronic manifold valve coupled to the control panel, the second liquid discharge outlet being located on the second lateral truck side;

a third liquid discharge outlet in communication with the discharge manifold and operative to discharge liquid via a third electronic manifold valve coupled to the control panel, the third liquid discharge outlet being located on the rear; and a fourth liquid discharge outlet in communication with the discharge manifold and operative to discharge liquid via a fourth electronic manifold valve coupled to the control panel, the fourth liquid discharge outlet being located on the rear, distal from the third liquid discharge outlet.

6. The firefighting apparatus of claim 5, wherein the control panel includes a touch screen display operable to control the first, second, third and fourth discharge valves.

7. The firefighting apparatus of claim 6, wherein each of the first, second, third and fourth liquid discharges are 2.5 inch discharges.

8. A firefighting apparatus comprising:

a chassis;

a drivetrain mounted to the chassis;

an engine mounted to the chassis and the drivetrain, the engine including a power take off joined with a primary pump, the primary pump capable of pumping liquid at a rate of at least 1000 GPM;

a discharge manifold mounted to the chassis and in fluid communication with the primary pump, the discharge manifold including a plurality of electronically controlled manifold valves, each in communication with a control panel operable by a user of the apparatus;

a front axle and a rear axle, joined with respective front wheels and rear wheels, each of the front wheels and rear wheels being powered by the drivetrain and configured to enable transportation of the apparatus to an off road emergency location, the front and rear axles separated such that a wheelbase of the chassis is less than 160 inches;

a front overhang of the chassis extending forward of the front axle, and a rear overhang extending rearward of the rear axle, the front overhang terminating at a bumper guard forward of the front wheels such that the chassis has an angle of approach between 20 degrees and 40 degrees inclusive, the rear overhang terminating at a rear bumper guard so that the chassis has an angle of departure between 22 degrees and 40 degrees inclusive;

a cab mounted to the chassis above the front axle and configured to house at least two occupants, the cab including a front of the apparatus;

a body located rearward of the cab, the body having an upper deck, the rear axle and rear wheels being located under the body, the body including a rear of the apparatus, the body separated from the cab by less than 30 inches so that the wheelbase is condensed to the less than 160 inches;

a tank mounted in the body and configured to store at least 400 gallons of liquid;

a side to side width extending across the body from a first lateral truck side to a second lateral truck side opposite the first lateral truck side;

a longitudinal axis extending from the cab toward the body;

a deck gun rotatably mounted on the upper deck and configured for application of water from atop the body over at least one of the first lateral truck side, the second lateral truck side, the front and the rear;

a first hose reel with a first hose in communication with the tank, the first hose reel mounted to the body and configured to enable deployment of the first hose from the body;

a combustion secondary pump mounted to the body and in fluid communication with the first hose, the secondary pump capable of pumping liquid from the tank through the first hose while the apparatus is rolling over terrain; and a second hose reel with a second hose in communication with the tank, the second hose reel mounted to the body and configured to enable deployment of the first hose from the body, wherein the second hose is in fluid communication with the secondary pump, and capable of pumping liquid from the tank through the second hose while the apparatus is rolling over terrain, wherein the secondary pump is capable of pumping liquid at, at least 100 GPM, wherein the secondary pump is mounted above the tank adjacent the upper deck, wherein the first hose reel is mounted atop the body so that the first hose is deployable from the first lateral truck side, wherein the second hose reel is mounted atop the body so that the first hose is deployable from the second lateral truck side, wherein the primary pump and the secondary pump are in liquid communication with the discharge manifold, wherein the discharge manifold is operable in a pump and roll mode in which liquid from the tank enters the discharge manifold and is conveyed via the secondary pump but not the primary pump while the apparatus is moving, wherein the discharge manifold is operable in a stationary mode in which liquid from the tank enters the discharge manifold and is conveyed via at least one of an outlet and a base while the apparatus is stationary.

9. A firefighting apparatus comprising:

a chassis;

a drivetrain mounted to the chassis;

an engine mounted to the chassis and the drivetrain, the engine powering a primary pump capable of pumping liquid at a rate of at least 1000 GPM;

a discharge manifold mounted to the chassis and in fluid communication with the primary pump, the discharge manifold including a plurality of manifold valves, each in communication with a touch screen control panel operable by a user of the apparatus;

a front axle and a rear axle, joined with respective front wheels and rear wheels, each of the front wheels and rear wheels being powered by the drivetrain and configured to enable transportation of the apparatus to an off road emergency location, the front and rear axles separated such that a wheelbase of the chassis is less than 170 inches;

a front overhang of the chassis extending forward of the front axle, and a rear overhang extending rearward of the rear axle, the front overhang terminating at a front bumper guard forward of the front wheels such that the chassis has an angle of approach between 20 degrees and 40 degrees inclusive, the rear overhang terminating at a rear bumper guard so that the chassis has an angle of departure between 22 degrees and 40 degrees inclusive;

a cab mounted to the chassis above the front axle and configured to house at least two occupants, the cab including a front of the apparatus;

a body located rearward of the cab, the body having an upper deck, the rear axle and rear wheels being located under the body, the body including a rear of the apparatus, the body separated from the cab by less than 30 inches so that the wheelbase is condensed to the less than 170 inches, the discharge manifold being mounted to the chassis between the cab and the body;

a tank mounted inside the body and configured to store at least 400 gallons of liquid;

a side to side width extending across the body from a first lateral truck side to a second lateral truck side opposite the first lateral truck side;

a longitudinal axis extending from the cab toward the body; and a secondary pump mounted above the tank adjacent the upper deck and capable of pumping liquid at a rate of at least 100 GPM while the apparatus is moving.

10. The firefighting apparatus of claim 9, comprising:

a first liquid discharge outlet in communication with the discharge manifold and operative to discharge liquid via a first electronic manifold valve coupled to the touch screen control panel, the first liquid discharge outlet being located on a first lateral truck side;

a second liquid discharge outlet in communication with the discharge manifold and operative to discharge liquid via a second electronic manifold valve coupled to the touch screen control panel, the second liquid discharge outlet being located on a second lateral truck side;

a third liquid discharge outlet in communication with the discharge manifold and operative to discharge liquid via a third electronic manifold valve coupled to the touch screen control panel, the third liquid discharge outlet being located on the rear; and a fourth liquid discharge outlet in communication with the discharge manifold and operative to discharge liquid via a fourth electronic manifold valve coupled to the touch screen control panel, the fourth liquid discharge outlet being located on the rear, distal from the third liquid discharge outlet.

11. The firefighting apparatus of claim 9 comprising:

a first ground sweep sprayer mounted to the front bumper guard and configured to spray liquid forward of the front; and a second ground sweep sprayer mounted to the front bumper guard and configured to spray liquid forward of the front, the second sprayer being mounted closer to the second lateral truck side than the first sprayer.

12. The firefighting apparatus of claim 11, wherein the first ground sweep sprayer is in liquid communication with the discharge manifold, wherein the first ground sweep sprayer is operative to discharge liquid via a fifth electronic manifold valve coupled to the touch screen control panel;

wherein the second ground sweep sprayer is in liquid communication with the discharge manifold, wherein the second ground sweep sprayer is operative to discharge liquid.

13. The firefighting apparatus of claim 9 comprising:

a first hose reel with a first hose in communication with the tank, the first hose reel mounted to the body and configured to enable deployment of the first hose from the body from the first lateral truck side, a second hose reel with a second hose in communication with the tank, the second hose reel mounted to the body and configured to enable deployment of the second hose from the body from the second lateral truck side.

14. A firefighting apparatus comprising:

a chassis;

a drivetrain mounted to the chassis;

an engine mounted to the chassis and the drivetrain, the engine powering a primary pump capable of pumping liquid at a rate of at least 1000 GPM;

a discharge manifold mounted to the chassis and in fluid communication with the primary pump, the discharge manifold including a plurality of manifold valves, each in communication with a touch screen control panel operable by a user of the apparatus;

a front axle and a rear axle, joined with respective front wheels and rear wheels, each of the front wheels and rear wheels being powered by the drivetrain and configured to enable transportation of the apparatus to an off road emergency location, the front and rear axles separated such that a wheelbase of the chassis is less than 170 inches;

a front overhang of the chassis extending forward of the front axle, and a rear overhang extending rearward of the rear axle, the front overhang terminating at a front bumper guard forward of the front wheels such that the chassis has an angle of approach between 20 degrees and 40 degrees inclusive, the rear overhang terminating at a rear bumper guard so that the chassis has an angle of departure between 22 degrees and 40 degrees inclusive;

a cab mounted to the chassis above the front axle and configured to house at least two occupants, the cab including a front of the apparatus;

a body located rearward of the cab, the body having an upper deck, the rear axle and rear wheels being located under the body, the body including a rear of the apparatus, the body separated from the cab by less than 30 inches so that the wheelbase is condensed to the less than 170 inches, the discharge manifold being mounted to the chassis between the cab and the body;

a tank mounted inside the body and configured to store at least 400 gallons of liquid;

a side to side width extending across the body from a first lateral truck side to a second lateral truck side opposite the first lateral truck side;

a longitudinal axis extending from the cab toward the body;

a first hose reel with a first hose in communication with the tank, the first hose reel mounted to the body and configured to enable deployment of the first hose from the body from the first lateral truck side;

a second hose reel with a second hose in communication with the tank, the second hose reel mounted to the body and configured to enable deployment of the second hose from the body from the second lateral truck side; and a combustion secondary pump mounted to the body and in fluid communication with the first hose and the second hose, the secondary pump capable of pumping liquid from the tank through at least one of the first hose and the second hose while the apparatus is rolling over terrain, wherein the secondary pump is capable of pumping liquid at a rate of between 100 GPM and 200 GPM, inclusive, wherein the secondary pump is mounted above the tank adjacent the upper deck, wherein the primary pump and the secondary pump are in liquid communication with the discharge manifold, wherein the discharge manifold is operable in a pump and roll mode in which liquid from the tank enters the discharge manifold and is pumped via the secondary pump but not the primary pump, wherein the discharge manifold is operable in a stationary mode in which liquid from the tank enters the discharge manifold and is pumped via the primary pump but not the secondary pump.

15. The firefighting apparatus of claim 14, wherein the secondary pump is mounted above the primary pump, wherein the secondary pump is capable of pumping liquid at a rate of at least 150 GPM, wherein the primary pump is capable of pumping liquid at a rate of at least 1500 GPM.

* * * * *